United States Patent [19]

Romney

[11] 3,955,504

[45] May 11, 1976

[54] EXPLOSIVE BOOSTER CASING

[76] Inventor: Russell H. Romney, 3259 Bon View Drive, Salt Lake City, Utah 84109

[22] Filed: June 26, 1974

[21] Appl. No.: 483,212

Related U.S. Application Data

[63] Continuation of Ser. No. 337,434, March 2, 1973, Pat. No. 3,831,522.

[52] U.S. Cl. ..... 102/24 R

[51] Int. Cl.[2] ..... F42B 3/02

[58] Field of Search ..... 102/24

[56] References Cited

UNITED STATES PATENTS

| | | | |
|---|---|---|---|
| 1,997,958 | 4/1935 | Wingard | 102/64 X |
| 3,613,582 | 10/1971 | Levamaki | 102/24 HC |
| 3,831,522 | 3/1973 | Romney | 102/24 R |

*Primary Examiner*—Verlin R. Pendegrass

[57] ABSTRACT

A casing or shell for explosive material to be used as a booster for detonating massive charges of blasting agents of low sensitivity is formed in two generally hemispherical half shell or casing members which are formed with sufficient precision that the two parts may lock together in telescoped relationship after filling, to form a liquid-tight joint. The two half shells are quite similar in size and shape but not identical, one bearing a flange having a hollow cylindrical inner surface into which a mating flange on the other is received; interlocking elements inside the outer flange and on the exterior surface of the inner flange hold the parts securely together by friction and without adhesive after full assembly. Each half shell includes a thin-walled tubular element which projects through and frictionally engages an opening in the other half shell as the two members are assembled, the parts being so arranged that a filling port and an air outlet port are provided when the parts are brought together but only partially closed to final position, these ports being closed completely when the two half shells are finally forced tightly together. The tubular elements are designed to receive and hold a primary detonator, such as an electric blasting cap or a length of detonating cord, and to hold such detonator securely in place after the booster is filled and sealed.

11 Claims, 12 Drawing Figures

EXPLOSIVE BOOSTER CASING

BACKGROUND AND PRIOR ART

The present application is a continuation of application Ser. No. 337,434 filed Mar. 2, 1973, and now U.S. Pat. No. 3,831,522, entitled "Explosive Booster and Container Therefor".

As more fully explained in the parent application, it is often necessary or desirable in blasting operations to use boosters filled with a relatively sensitive explosive to fully detonate large masses of blasting agents which commonly are relatively less sensitive. That is, many blasting agents which are used on a large scale in mining and construction operations cannot be reliably set off or detonated by use of small conventional initiators such as electric blasting caps or lengths of detonating cord, the latter being slender tubular casings filled with sensitive explosive composition. In order to prevent waste of the main blasting agents and to avoid hazard due to their incomplete detonation, or to avoid failure of detonation, boosters are used which carry a sizable mass of an explosive of intermediate sensitivity. These are formed around the sensitive cap or cord which constitutes the primary initiator. Some of the prior art boosters may comprise or consist of a molded block of TNT (trinitrotoluene) in which a cap or other initiator of sensitive material is enclosed; see U.S. Pat. No. 3,037,452, for example. Some include a very sensitive primary cap, surrounded by a first small mass of explosive material which is quite sensitive and certain to be fully detonated by the initiator; this small mass in turn is surrounded by a still larger mass of semi-sensitive material (of which TNT may be typical). The latter is a so-called two stage booster. Variations are known in the prior art; see for example U.S. Pat. Nos. 3,037,453; 3,359,902; 3,379,906 and others.

In view of the hazards of shipping large quantities of blasting agents from manufacturing plant to a mine or other blasting site it has become the custom, to an increasing degree, to formulate explosives in the field. That is, the ingredients which make up the blasting agent and which, before being combined, are quite inert, may be shipped separately to the field, e.g., to a large open pit or underground mine, and then combined at the blasting site or near it just before they are used. To some degree a similar procedure may be desirable in preparing boosters. Since each booster includes at least one explosive composition in addition to the primary initiator (cap or detonating cord), it may be desirable to leave either the composition or the sensitive initiator, or both, out of the booster until it is at or near the site before making it ready for use. With most boosters of the prior art this is not feasible because they may require that the filler (such as TNT, for example) be melted at the factory for pouring into the booster casing. The manufacture of such boosters often is or may be a delicate operation which must be carried out under closely controlled conditions that cannot be performed conveniently in the field. Also, the main charge in the booster may be liquid or semi-liquid, in which case the filling operation cannot be reliably performed in the field but must be done with precision filling equipment, etc. However, in many cases, field filling of boosters is quite feasible if they can be designed for such.

Additional problems that may be encountered may involve the leakage of liquid filling materials out of filled boosters before they are used or the leaking of water into the booster after it has been filled and submerged in a borehole in the presence of ground water or in the presence of other liquids such as liquid components of blasting slurries. To form the booster so that it will not leak explosive material out or allow water to seep in, especially when the booster is submerged to a depth where hydrostatic pressure around the booster is high, can be a difficult problem with devices of the prior art.

An object of the present invention is to so design the booster shell or casing that it can be filled conveniently, in the field, if desired, and in a manner to avoid spilling or leakage. Preferably, the booster is filled completely enough that pockets of air or other voids are eliminated, and with liquid tight sealing all around the explosive charge which it contains. A further object is to so design the booster casing that it can resist high external pressure without collapsing and without making its walls so thick that it may fail to transmit the full detonation wave as required for full detonation of the main blasting charge. Still a further object is to design the shell or casing components so that separately formed parts may be locked securely together, preventing tampering after the booster is filled. It is desirable, also, that the design be such that simple filling operations be used, and an ancillary object is to design the interlocking parts so that, as first assembled, but not pressed to a fully closed position, the shell may be filled with liquid, semi-liquid, or plastic semi-solid material, or in some cases with a charge of granular or powdered booster material, while air inside the casing is permitted to escape as the filling material enters, and then by forcing the parts together more tightly after filling is completed, the parts are sealed securely against escape of the filler or entrance of water or other liquid from the outside, even when the booster is submersed to considerable depth under water or other liquid.

Additional objects include means for securely holding in proper place the primary detonator after the latter has been introduced into the booster. The booster is preferably formed so that the primary initiator, cap or blasting cord, may be inserted into a tubular holder and properly positioned and retained there, as near the center of mass of the booster material as is feasible. In situations where a single booster may be inadequate or marginally so, it may be desirable to use two or more boosters and a further object of this invention is to facilitate the assembly and holding together of multiple boosters when more than one is needed to insure full detonation of a main blasting charge.

Further objects, advantages and features of the invention will become apparent as detailed descriptions of the preferred embodiment and of minor modifications thereof are given.

DESCRIPTION OF PREFERRED EMBODIMENT

Figure 1:
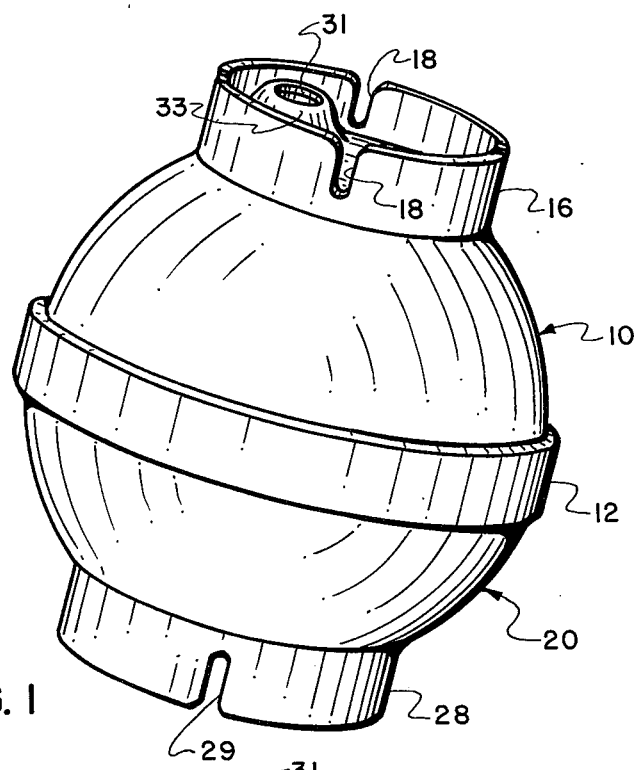
FIG. 1 is a perspective view of an assembled booster shell or casing of a preferred form.
Figure 3:
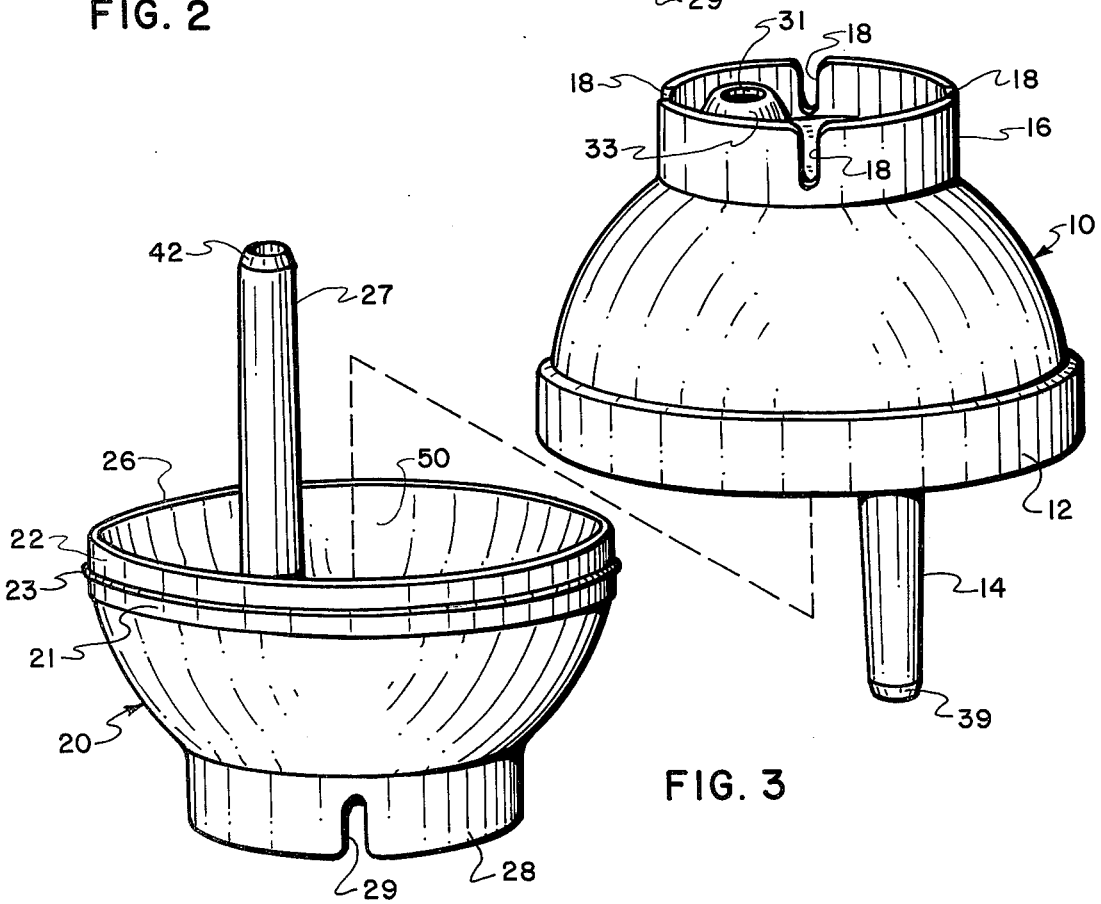
FIG. 3 is an exploded view of the booster casing of FIG. 1, showing its two main hemispherical or half shell components separated to better illustrate the internal construction.

FIGS. 1 and 3 show a preferred general arrangement of the main elements which make up the shell or casing for a booster which has a large and generally spherical cavity to be filled with a semi-sensitive explosive material. This main booster charge is to be detonated by a primary initiator such as a cap or a blasting cord of conventional type. The casing or shell consists of two more or less hemispherical half shells 10 and 20 which are assembled or partly assembled prior to filling, the final step of assembly being completed after filling the main cavity 50 with the booster explosive, usually a semi-sensitive filler material. The upper half shell member or part 10 is formed with a dependent peripheral flange 12 having a generally cylindrical inner surface and the lower part 20 has its upper part 21 shaped to fit snugly into this cylindrical flange when the parts are fully assembled. A hollow cap or cord-receiving tube 14 is formed integrally with the upper half shell. At its top, the upper half shell member 10 has a cylindrical flange 16 projecting vertically, that is, concentric with the vertical axis of the shell or casing. A plurality of notches 18 are provided in this flange to receive cord or wire for tying parts together and/or for connecting to the initiator, as will be further explained.

The lower half shell or casing 20 has also a cap or cord receiving tube 27, preferably formed integrally with it, the parts preferably being produced by precision injection molding. Both the tube 14 and the tube 27 are formed with thin walls for most of their length so that the detonation wave of the initiator will be effectively transmitted to the booster filler, detonating the latter completely. This is done, of course, so that the main charge of blasting agent, in which the booster is positioned, will be fully detonated in turn by the booster charge.

The outer peripheral surface of the upper part 21 of the lower half casing 20 is formed with an essentially cylindrical surface 22 exteriorally and sized accurately so that it will enter and fit snugly within the bottom flange 12 of the upper part 10. These parts are formed with care so that even before the two halves are pushed fully or tightly together, as will be further explained, they form a reasonably firm and liquid-tight connection. The upper edge 26 of part 21 is rounded, shown in FIG. 5 at 26, and is designed to serve as a sealing element to prevent passage of liquid. When the parts are fully pressed together, edge 26 fits into a groove 15 inside the part 10, formed in a shoulder 80 at the inside top of flange 12. In addition, the part 21 bears a peripheral external rib 23 all around its cylindrical outer surface which is designed to interlock with a groove 17 formed peripherally inside the interior cylindrical surface of flange 12. The rib and groove parts interlock strongly to hold and lock the two half shells against separation after they have once been tightly pressed together. This prevents tampering with a filled booster. These parts also serve as liquid-tight seals, and in this function they are assisted by the interfit between the parts 15 and 26, as best seen in FIG. 4.

Figure 4:
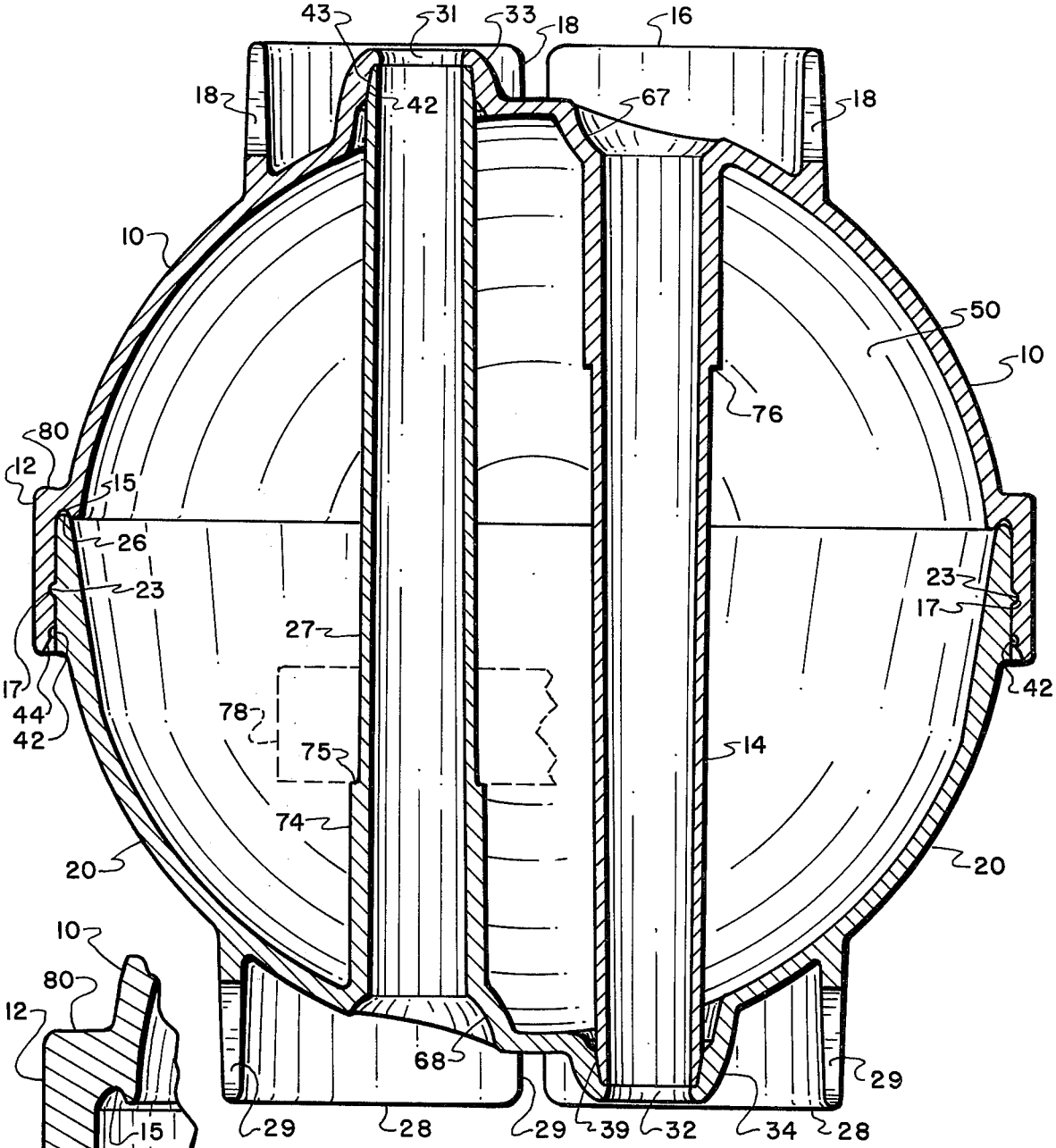
FIG. 4 is a vertical sectional view of the booster shell of FIG. 1.

The bottom half shell member 20, as seen in FIG. 4, is provided with a downwardly depending circular skirt or flange 28 on which it may rest on a flat or plane supporting surface. This flange is notched at several points 29, spaced similarly around the periphery to match the notches 18 in the upper flange 16, to receive a cord or wire for detonation and/or for securing two or more boosters together. The flange 28 at the bottom is just enough larger in diameter than the flange 16 at the top, that the latter will fit neatly into it, thus providing for stable stacking or nesting the boosters or casings, and making it convenient also to secure two or more shells together for multiple boostering, as shown clearly in FIG. 2.

Openings 31 and 32, respectively, are formed in protruding bosses or pockets 33 and 34 in the upper part 10 and in the lower part 20, respectively. These protrusions 33 and 34 are of hemispherical or partly spherical shapes on the outside to facilitate connecting to them a filler nozzle 40, indicated in dotted lines at the bottom of FIG. 6. For filling the main cavity 50, FIG. 4, with liquid, and especially with a viscous liquid, such as a sensitized slurry, or with a thickened liquid or semi-plastic booster explosive, or a granular or powdered booster explosive, it is preferred that the explosive material be introduced at the bottom, through the filler nozzle such as 40, which may be of any conventional type. In this case the filler rises as it is introduced and the opening 31 at the top serves to permit air to flow out of the cavity 50 as it is filled. Obviously, when the parts are tightly assembled, as shown in FIG. 4, the bottom or filler opening 32 is closed with respect to cavity 50 by reason of the slightly tapered bottom end 39 of the detonator-receiving tube 14 fitting snugly into the similarly shaped and recessed inner part 41 of the protrusion 34. Similarly, at the top, the air cannot escape when the parts 10 and 20 are tightly assembled, as shown in FIG. 4. Then opening 31 is similarly closed by the slightly tapered upper end part 42 of the tube 27 which fits in a tapered socket 43. That is, when the parts are tightly and completely assembled, as in FIG. 4, no filler material can be introduced into the cavity 50 and no air, if entrapped therein, could escape. It is necessary, therefore, that the parts 10 and 20 be fastened together for filling but that the filler and air outlets remain open.

Figure 5:
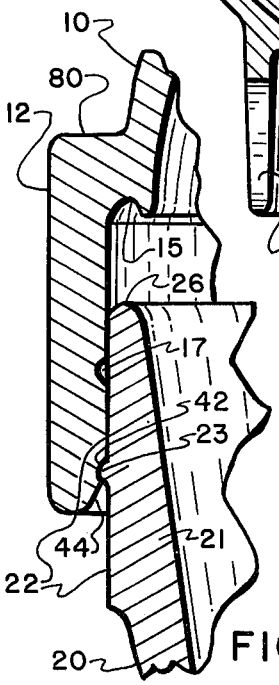
FIG. 5 is an enlarged sectional detail view, showing certain interfitting and interlocking elements which secure the half-shell elements of the casing together in liquid-tight relationship.

Consequently, the parts are fitted so that they may be brought together in a snug, interfitting preliminary but securely holding position without closing the main cavity 50 with respect to either the filler opening 32 or the air outlet opening 31. The relationships between the interfitting parts during a filling operation are shown best in FIGS. 5 and 6. In FIG. 5, the upper part of the hemispherical wall of part 26 is set part way only, not all the way, into the downturned flange part 12 of the upper half shell 10. The lower inside edge of flange 12 is flarged outwardly at its bottom edge as shown at 44, FIG. 5, to guide the sealing edge part 26 of the lower member into the cylindrical inner part of flange 12. The parts are pushed together only until the bead 23 on the lower part just begins to engage a groove 42 in this cylindrical inner portion of the flange 12. In this position, there is a liquid-tight seal between the inner part 22 and the inside surface of flange 12, both of these parts being essentially cylindrical in shape and close fitting.

Figure 6:
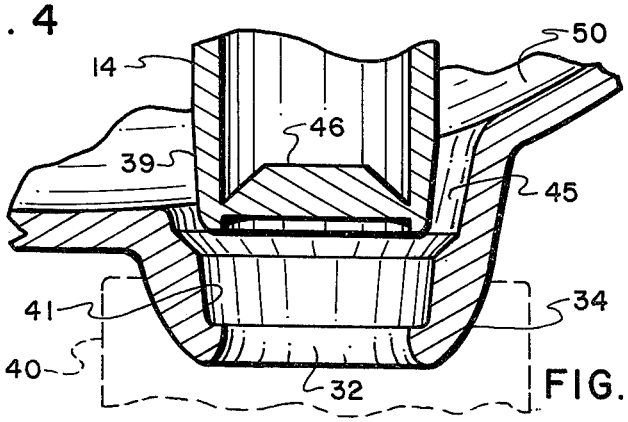
FIG. 6 is another enlarged sectional detail view, showing how a filler opening is provided when the parts are preassembled but still spaced from closed position, i.e., not tightly locked together.

Referring now to FIG. 6, the relationship between the lower end part 39 of tube 14 and the inner surfaces of boss or protrusion 34 are shown as of the time when the main half shell parts are in the relative positions shown in FIG. 5. That is, the tube 14 is set back from and does not block the opening or passageway from the filler tube or nozzle 40 into the main cavity 50. Filling material can be introduced then through the annular passageway 45, FIG. 6. In this Figure, the lower end of tube 14 is shown as being closed by a frangible plug 46. This plug is molded integrally with the tube and other parts of the upper half shell 10; it can be broken or cut out quite easily when and if it is desired to leave tube 14 open at both ends. In FIG. 4, tube 14 is shown to be open at both ends, to permit passage through it of a detonating cord or the like, as in FIG. 11.

Figure 8:
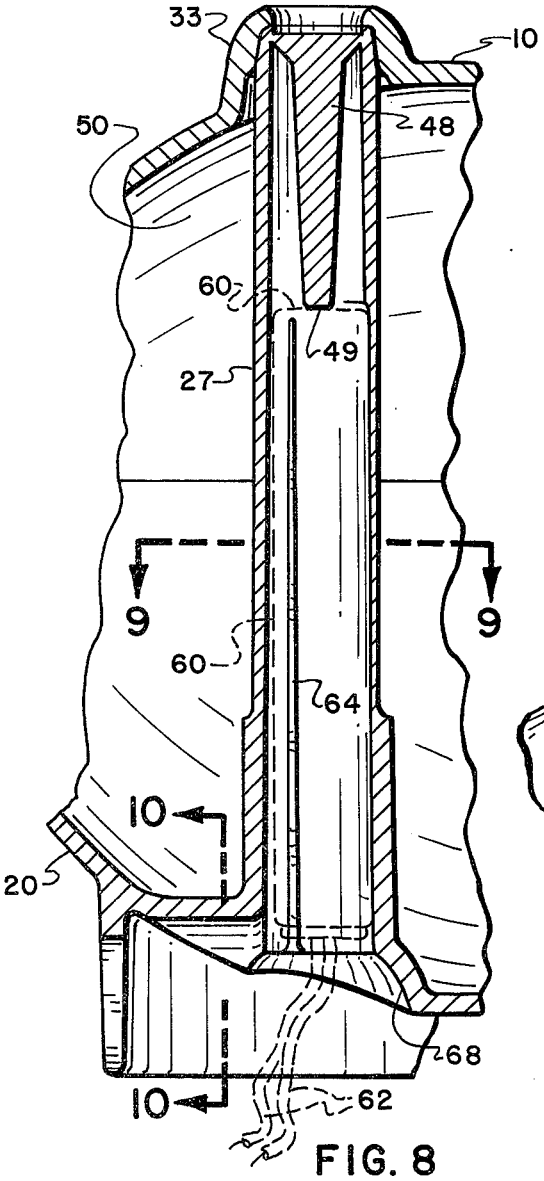
FIG. 8 is a fragmentary sectional view showing details of the tube or receptacle which contains and holds a primary initiator or blasting cap.
Figure 9:
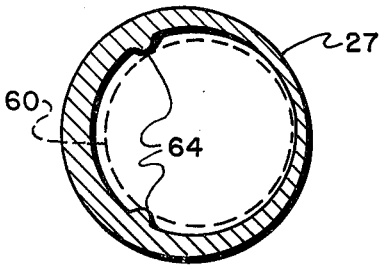
FIG. 9 is a cross sectional detail of the tube, taken substantially along the line 9—9 of FIG. 8.

Similarly, the upper end of the other tube 27 may be open, as in FIG. 4, or it may be closed by a similar frangible plug 48, as shown in FIG. 8. In the latter case, the plug 48 is provided with an extending part 49 which serves as a stop to position a blasting cap or the like as near as convenient to the center of mass of the booster explosive contained in cavity 50. In this case an electric blasting cap 60 of standard type is shown inserted in tube 27 with its upper end resting against the positioning stop 49 and with its wires 62 extending down towards a source of electric power, not shown, which will detonate the device. In order to hold the cap 60 in place properly, after it has been inserted, light vertical ribs or ridges 64 are formed to protrude inwardly in tube 27 and thus to frictionally engage the sides of the cap 60. These are shown in section in FIG. 9. On the other hand, if it is desired to use a cord type detonator and pass it entirely through the tube 27 (or the tube 14, or both) the frangible plug 48 and/or plug 46 may be broken or cut out to allow such passage. In either case the tube wall is made as thin as it may be to maintain sensitivity. Obviously, for filling with liquid explosive, and especially with a viscous liquid, the plug 46 at the filler opening should be left in place until the cavity 50 has been filled and the casing sealed shut. Obviously, also, the filler may be introduced through the top opening 31 instead of opening 32, if desired.

After the casing, assembled in preliminary position as shown in FIGS. 5 and 6, has been filled, with the liquid or other material inside cavity 50 rising to or substantially to the level of the air outlet opening 31 (which also is open for air flow, similar to opening 32 and passageway 45), the parts 10 and 20 are finally pushed tightly together into the positions shown in FIG. 4. When this is done, the rounded upper edge 26 of the lower member engages the groove 15 of the upper member and the rib 23 engages in the groove 17 as in FIG. 4 to further seal the parts together. In its thus filled condition the booster is capable of resisting very high external pressures and it may be submerged 100 feet or more under water, if desired, without collapsing and without letting water in or explosive material out.

Figure 2:
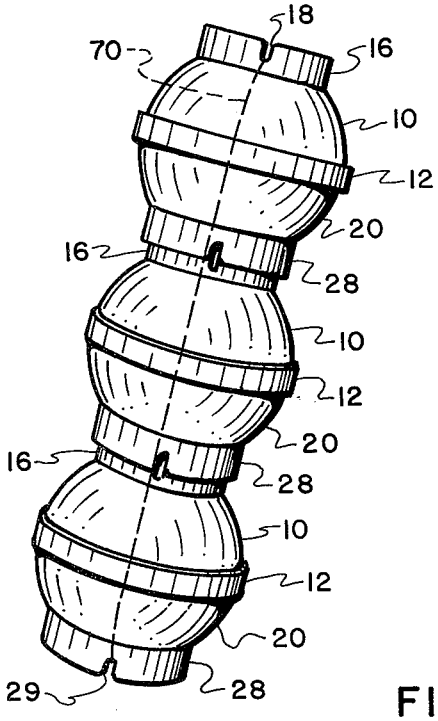
FIG. 2 is a view on a smaller scale of a plurality of boosters as in FIG. 1, secured together for multiple boostering as may be needed for detonating a blasting charge that is difficult to set off.
Figure 7:
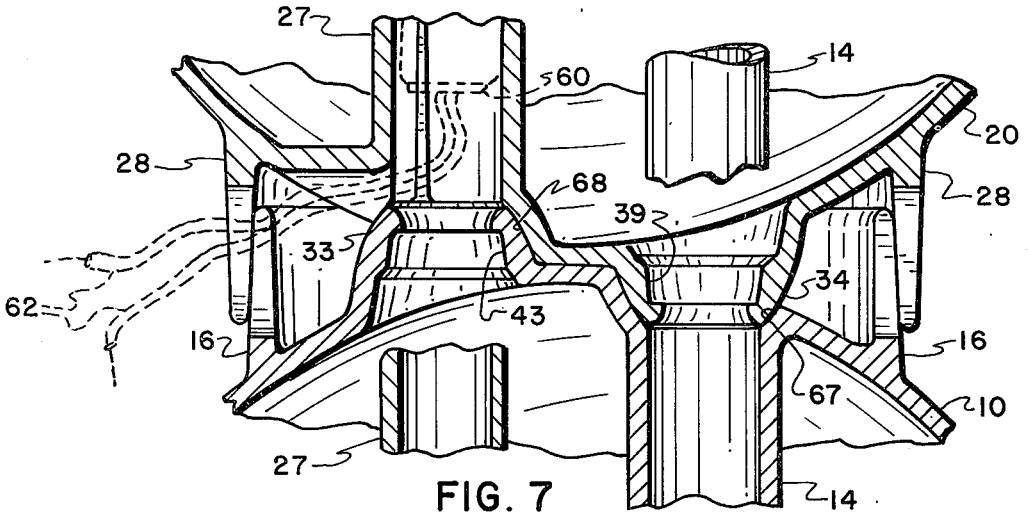
FIG. 7 is an enlarged fragmentary sectional view showing the relationship between parts of two separate boosters assembled together for a multiple boostering operation.
Figure 10:
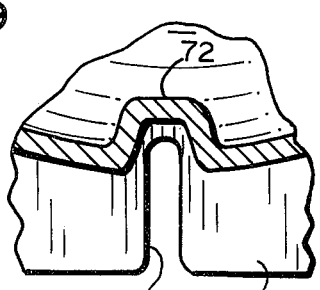
FIG. 10 is a horizontal sectional detail view through the base of a booster shell, showing means for receiving and holding a string, wire, or detonating cord for securing plural boosters together, for multiple boostering or for packaging or convenient carrying.
Figure 11:
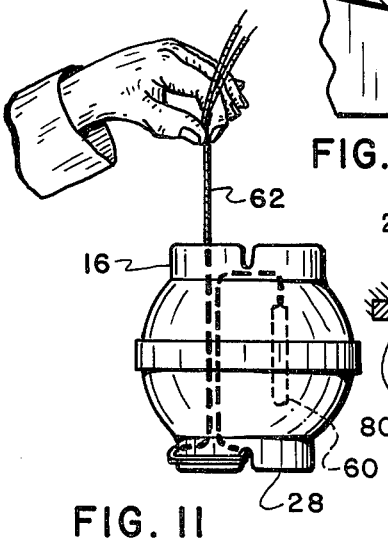
FIG. 11 shows a booster with a blasting cap and the necessary electric wires applied, as for detonation by an electric or spark type detonator.

When two or more boosters are assembled, as seen in FIG. 2 the bottom and top flanges 28 and 16, of the different boosters can nest together as previously explained. This is shown in FIG. 7. In addition, the hemispherical boss or protrusion 34 on the bottom of one booster, shown on top, FIG. 7, seats neatly into a similarly shaped and sized pocket 67 in the upper end of a tube 14 of the booster below. The upper boss or protrusion 33 of the booster below fits into a similar pocket or flared opening 68 at the bottom of a tube 27 in the booster above. Thus the parts are well supported and fit together neatly and firmly. Boosters may be tied together with strings or wire 70, FIG. 2, or by using a detonating cord or a detonating electric wire, as shown in FIG. 11. The notches 18 in the upper flange 16 and notches 29 in lower flange 28 are aligned when the boosters are assembled for multiple use (or simply for packaging) and the cord or wire is passed through these notches which are formed as shown in FIG. 10 with reinforcing indentations 72 into the main cavity 50.

For transportation to a site for use, it often may be preferable to leave the boosters unfilled, provision being made for filling at the blasting site for safety reasons. In this case the boosters may be assembled to the partly open or filling position as shown in FIGS. 5 and 6. Being open to the atmosphere, there is no problem with shipping them in airplanes or in storing at widely different altitudes because air can flow freely into or out of each casing through the openings 31, 32, 45, etc. The casings can thereafter be filled at the site and the detonating cap or cord can be inserted in position after filling or just prior to placing the booster in the explosive charge to be detonated. The safety features thus afforded are obvious.

For convenience in filling, it may be desirable to tilt the assembled casing slightly, at an angle to the vertical, more or less as shown in FIG. 1. In this position, as the casing is filled, as in FIG. 6, the filling material will rise to the outlet 31, thus making sure that all the air has been evacuated from the shell. As noted above, the completely filled casing or shell may be subjected to very high external pressures, particularly if the filling is a substantially incompressible liquid, as is often the case. The liquid may become solidified at lower temperatures but most liquids do not expand on freezing nearly as much as water does, so there is little or no danger of bursting the shell. When materials such as TNT are melted for filling, they do not expand at all on freezing; in some cases they may contract slightly but not enough to impair substantially the compressive strength of the booster.

The taper between parts 39 and 41, FIG. 6, or between parts 42 and 43, FIG. 4, is similar to that used in the "Leur Loc" system for hypodermic needles and the like. It assures a good tight seal without press fitting.

As shown best in FIG. 4, the tube 27 which is integral with the lower half shell 20 is quite thin-walled for most of its length, to provide for effective transmission of the shock wave from the initiating cap or blasting cord through the wall to the semi-sensitive explosive filler material in the main cavity 50. This is a preferred arrangement. However, the base portion of either tube such as 27 or 14 may be somewhat greater in thickness, as shown at 74 for greater strength and to provide a shoulder 75 against which a ring or doughnut type explosive mass 78 may be set. In some cases, it may be desirable to use such a mass as a first stage of a two-stage booster, in a manner analogous to that described in U.S. Pat. Nos. 3,037,452, 3,371,606, and others. A similar construction including a shoulder 76 may be used for tube 14.

The top and bottom flanges 16 and 28 serve several useful functions. They give protection to the sealing parts 39, 41, and 42, 53 which they surround. They provide for nesting one container or booster in another to facilitate packaging and shipping as well as for multiple boostering. Through the notches 18 and 29 they provide anchorage for tying cords, or electric blasting cap wires or for cord type detonators. They also facilitate the connection and alignment of conventional filling nozzles 40 for introducing liquid or granular filling into the main cavity of the booster. They provide also a stable base for setting the booster on a plane supporting surface, so that it will not roll away. Thus they facilitate storing, stacking and handling of the empty or filled booster casings.

Figure 12:
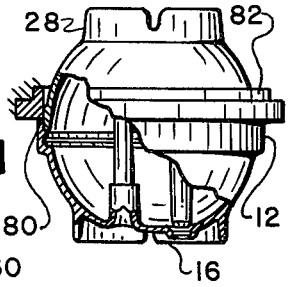
FIG. 12 is a small scale view showing how the filling procedure may be modified for forcing viscous liquid or semi-solid plastic filler material into the casing.

In certain cases, for example, when the booster is to be filled with a thick slurry or a very viscous or semi-solid liquid, it may be desirable to invert the booster from its normal position, where it is shown, as in FIGS. 4, 6, and others, to a position as shown in FIG. 12. The reason for this is that the flange 12 includes the shoulder 80 which is particularly suitable for giving strong support against the thrust of a viscous liquid flowing through the openings such as 32 and 46 without closing the filling channel. Openings at the top, as at 31, etc., are identical with these; by using a ring shaped back-up or thrust resisting member 82 above this flange 12, the nozzle 40 may be held with greater force against the filler opening 31 than in the case of the arrangement of FIG. 4. That is, if the parts 10 and 20 were partly assembled, as for normal filling, see FIG. 6, and a substantial thrust were exerted against the bottom member 20, FIG. 5, the booster would close or tend to close up to the position shown in FIG. 4, thus shutting the annular filling opening 46, FIG. 6. By backing the flange 12 against the solid back-up ring 82 placed above it, as in FIG. 12, filling can proceed without risk of forcing the container to fully closed position. This, if it occurred, would prevent complete filling. For normal operation, the arrangement shown in FIGS. 4, 5 and 6 is preferred because the flange 28 is somewhat larger in diameter than flange 16 and provides a somewhat more stable base to rest the booster on, before, during or after filling.

From the above description, it will be appreciated that the booster casings of the present invention have a number of advantages over prior art products. Some of these may be summarized as follows:

a. There are only two injection molded half shells, so no caps, lids, sealing strips, or other closures or auxiliary parts are needed.
b. The casings are suitable for injection molding from various kinds of suitable synthetic plastic or resinous materials at low cost, using multi-cavity, runnerless, automatic molds that require no moving cores.
c. The parts are readily made in various sizes, as needed, and of sufficient dimensional accuracy that they form effective mid-seal and port seals, being well locked together without tape, cement, or fasteners of any kind and being particularly suitable for final loading at the blasting site for greater safety.
d. They are waterproof, capable of being submerged in water or in slurry explosive to depths of 100 feet or more, and they are not adversely affected by wide changes in altitude for shipping or storing.
e. They can be molded selectively for varying uses and environments from a wide variety of thermoplastic or thermosetting resins for maximum resistance to various chemicals or other materials.
f. Their essentially spherical configuration provides maximum boostering efficiency, maximum mechanical strength and rigidity and they are suitable for substantially bubble-proof filling.
g. They can be used with a wide variety of initiators, including fuse or electric blasting caps, detonating cords, etc.
h. Explosive reliability is assured because of the thin walled tubings in which the primary initiators may be placed at optimum positions.
i. Filling ports are large enough to permit use of very viscous and even non-liquid or semi-solid filler materials, including many kinds of explosive compositions.
j. The shells are designed for filling either at factory or blasting site with automatic equipment or they may be filled manually, using simple equipment.
k. Being designed for stacking or nesting, they simplify packing, shipping and use in multiple boostering operations.
l. The booster casings are neat and efficient in appearance and design.

It will be obvious that various modifications and alterations may be made in the booster casings of this invention, including those mentioned above and many not mentioned, without departing from the spirit and purpose of the invention. It is intended by the claims which follow to cover such modifications, variations and alterations as would suggest themselves to those skilled in the art as broadly as the state of the art properly permits.

What is claimed is:

1. A molded booster shell or casing having wall elements enclosing a major cavity of substantially spherical shape for holding a charge of explosive booster composition, said shell or casing consisting essentially of a pair of generally similar and substantially hemispherical half shell members joined together in a sliding telescopic liquid tight adhesive-free joint lying substantially in an equatorial band around said cavity, said joint being sufficiently liquid tight in an initial partly closed position to permit filling of the major cavity with said charge without objectionable leaking at the joint, each of said half shell members comprising an integral hollow tube positioned near the center of mass of said cavity and projecting from the wall of one shell completely through the major cavity and frictionally sealable in said liquid tight relationship in an opening in the wall of the opposite shell, at least one of said tubes being sized and shaped to receive and retain a primary initiator in detonating position near the center of mass of said cavity, at least one of said tubes being arranged to leave a filler opening at said opening in the opposite wall when the parts are in said initial partly closed position and to close and seal said opening when said sliding telescopic joint is completely closed.

2. A booster shell or casing according to claim 1 in which the friction joint between the two half shell members comprises closely fitted telescoping cylindrical surfaces on the respective half shell members and a rounded protrusion on one member matching a receiving groove on the other.

3. A booster shell or casing according to claim 1 in which the protrusion is a circumferential rib formed on one of said cylindrical surfaces and the groove is positioned in the opposite cylindrical surface.

4. A booster casing or shell according to claim 1 in which the protrusion is the edge of the cylindrical surface and the groove is formed in a shoulder part of the opposite half shell.

5. A booster casing as in claim 1 in which at least one of the tubes is closed at one end by a frangible plug and fits into a filler opening formed within an outwardly spherical-shaped boss positioned on the opposite half shell, said boss being shaped to receive and cooperate with a filler nozzle for forcing filler material into said cavity when the tube is not fully inserted into said filler opening, said tube also being adapted to close said filler opening when the half shells are brought fully together.

6. A booster casing as in claim 5 in which the frangible plug comprises a positioning stop for a cap-type detonator.

7. A booster casing as in claim 1 where one of said half shells comprises an annular flanged skirt portion for resting on a plane supporting surface.

8. A booster as in claim 1 wherein each of said half shells comprises an annular flanged skirt portion, said portions on the respective half shells being of different diameters so that one will fit neatly within the other to facilitate packing a plurality of said booster shells in nested relationship.

9. A booster casing as in claim 7 wherein the flange portions are notched to retain binding means for securing a plurality of said casings together in nested relationship.

10. A booster shell or casing according to claim 1 in which each of the tubes is open to receive a cord type detonator passing through the whole casing or shell.

11. A booster shell or casing according to claim 1 in which at least one of the tubes contains a frangible closing plug to control flow of liquid filler material into the cavity and around the end of said tube when the two half shell members are interengaged but are not in fully closed position, said tube shutting off said flow when the parts are in fully closed position.

* * * * *